United States Patent [19]

Harris et al.

[11] 4,011,115

[45] Mar. 8, 1977

[54] EXPLOSIVE COMPOSITIONS WITH THERMALLY CONDUCTIVE INGREDIENT

[75] Inventors: Roy Clifford Harris, Otford; John William Martin, Wilmington, both of England

[73] Assignee: The United States of America as represented by the Secretary of the Army, Washington, D.C.

[22] Filed: June 13, 1966

[21] Appl. No.: 557,869

[30] Foreign Application Priority Data

June 11, 1965 United Kingdom ..... 24878/65

[52] U.S. Cl. ..... 149/22; 149/24; 102/28 R

[51] Int. Cl.[2] ..... C06B 43/00; C06B 41/02

[58] Field of Search ..... 149/22, 24; 75/205; 29/182.5; 102/46, 28

[56] References Cited

UNITED STATES PATENTS

| | | | |
|---|---|---|---|
| 2,888,738 | 6/1959 | Taylor | 75/205 X |
| 3,208,846 | 9/1965 | Broma | 29/182.5 X |
| 3,262,763 | 7/1966 | Bechtold | 29/182.5 |
| 3,309,248 | 3/1967 | Rausch | 149/22 |

*Primary Examiner*—Edward A. Miller
*Attorney, Agent, or Firm*—Nathan Edelberg

[57] ABSTRACT

An explosive composition consisting of an explosive which contains an electrically conductive ingredient, and having a thermally conductive, electrically insulating substance incorporated therein in order to reduce the sensitivity of the composition to radio frequency.

3 Claims, No Drawings

EXPLOSIVE COMPOSITIONS WITH THERMALLY CONDUCTIVE INGREDIENT

This invention relates to explosive compositions and is particularly concerned with initiating compositions of the type, known as conducting compositions, which comprise a mixture of an explosive with an electrically conductive ingredient such, for example, as graphite or manganese dioxide.

It is well known that such compositions, when placed in a radio frequency field such as may be found, for example, in the vicinity of radar installations, are susceptible to radio frequency hazards; that is to say, to the risk of inadvertent ignition due to the formation of "hot spots" during the dissipation, through the composition, of energy picked up from the field. The critical factor in determining the power threshold, above which this dissipation will cause the composition to ignite, appears to be the thermal impedance of the explosive material to the conduction of heat away from the "hot spots".

The present invention aims at reducing this risk by improving the conduction of heat away from the "hot spots" and comprises a conducting composition in which is incorporated a proportion of a thermally conductive but electrically insulating substance, whereby the sensitivity of the composition to radio frequency hazards is reduced.

Examples of substances which give good results are boron nitride and silicon nitride. Beryllium oxide is also very good as a desensitiser but has the disadvantage that it involves the risk of serious toxic effects and, although these might be acceptable in some circumstances, one of the two nitrides would, normally, be preferred. Some effect may also be obtained from aluminum oxide and similar ceramic powders but these are much less effective than the previously mentioned additives.

The following are specific examples of the improvement obtained by the addition of boron nitride to conducting compositions comprising mixtures of graphite with lead styphnate.

The power dissipation threshold of one composition was raised from only 100 milliwatts to 2 watts by the incorporation of 10% by weight of boron nitride. In another composition, whose power dissipation threshold was normally about ½ watt, the incorporation of 5% of boron nitride raised the threshold to 1 watt, which is normally considered adequate, and the incorporation of 20% of the additive raised the threshold to 5 watts.

The proportion of additive is of course limited since the proportion of explosive and electrical conductant cannot be reduced indefinitely, and the preferred amount of additive would be between 5% and 20% by weight.

These additives produce very little change in the response of the compositions to normal initiation, any slight decrease in sensitivity being due to dilution of the mixture by the inert additive.

We claim:

1. In an explosive composition having an electrical conductive ingredient incorporated therein selected from the group consisting of graphite, lead styphnate and manganese dioxide; the improvement comprising the incorporation therein of a thermally conductive, electrically insulating substance selected from the group consisting of boron nitride, silicon nitride and beryllium oxide.

2. The composition of claim 1 wherein the amount of the thermally conductive, electrically insulating substance is between 5 and 20 percent by weight.

3. The composition of claim 1 wherein the electrical conductive ingredient consists of a mixture of graphite and lead styphnate, and the thermally conductive, electrically insulating substance is boron nitride in an amount of between 5 and 20% by weight.

* * * * *